United States Patent [19]

Hagar et al.

[11] Patent Number: 4,927,351

[45] Date of Patent: May 22, 1990

[54] METHOD AND SYSTEM FOR CONTROLLING THE SUPPLY OF FUEL AND AIR TO A FURNACE

[75] Inventors: Donald K. Hagar, Emmaus, Pa.; Robert W. McIntyre, 2845 E. Overlook, Cleveland Heights, Ohio 44118

[73] Assignees: Eagleair, Inc., Bethlehem, Pa.; Robert W. McIntyre, Cleveland Heights, Ohio

[21] Appl. No.: 393,150

[22] Filed: Aug. 4, 1989

Related U.S. Application Data

[63] Continuation of Ser. No. 917,900, Oct. 10, 1986, Pat. No. 4,887,958.

[51] Int. Cl.[5] ..... F23N 5/00

[52] U.S. Cl. ..... 431/12; 431/76; 431/90; 431/174

[58] Field of Search ..... 431/12, 14, 42, 75, 431/76, 78, 79, 80, 89, 90

[56] References Cited

U.S. PATENT DOCUMENTS

| | | |
|---|---|---|
| 2,210,428 | 8/1940 | Peabody . |
| 3,304,989 | 2/1967 | Alexander et al. . |
| 3,369,749 | 2/1968 | Siegmund et al. . |
| 3,549,089 | 12/1970 | Hamlett . |
| 3,988,104 | 10/1976 | Barber . |
| 4,043,742 | 8/1977 | Egan et al. . |
| 4,059,385 | 11/1977 | Gulitz et al. . |
| 4,109,613 | 8/1978 | Hayden et al. . |
| 4,435,149 | 3/1984 | Astheimer . |
| 4,477,245 | 10/1984 | Giachino et al. . |
| 4,504,216 | 3/1985 | Hagar et al. . |
| 4,645,450 | 2/1987 | West . |
| 4,653,998 | 3/1987 | Sohma et al. . |

FOREIGN PATENT DOCUMENTS

| | | | |
|---|---|---|---|
| 989040 | 5/1976 | Canada | 432/76 |

*Primary Examiner*—Carroll B. Dority

*Attorney, Agent, or Firm*—Foley & Lardner, Schwartz, Jeffery, Schwaab, Mack, Blumenthal & Evans

[57] ABSTRACT

A method and system are disclosed for providing fuel and air to a furnace. The furnace includes a plurality of burner assemblies, each with its own air valve for controlling the flow of combustion air therethrough. A sensing instrument for each burner assembly senses a condition reflecting the individual performance of that particular, separate burner assembly. A controller is coupled with the sensing instruments and with the air valves of the burner assemblies for controlling each individual air valve in response to the performance reflecting condition sensed by each sensing instrument. This results in individual control of the performance of each burner assembly of the set of burner assemblies feeding fuel and air to the furnace.

4 Claims, 3 Drawing Sheets

METHOD AND SYSTEM FOR CONTROLLING THE SUPPLY OF FUEL AND AIR TO A FURNACE

This application is a continuation, of application Ser. No. 06/917,900, filed Oct. 10, 1986 and now U.S. Pat. No. 4,887,758.

FIELD OF THE INVENTION

The present invention relates to furnace control and in particular to control of multiple burner assemblies which feed fuel and combustion air to a furnace. A typical application is the type of furnace which fires a boiler of a power plant.

BACKGROUND OF THE INVENTION

It is known to provide control systems to control the supply of fuel and air to furnaces, such as the type of furnace which is part of a boiler for a power plant. Such power plants normally have multiple burner assemblies in a windbox, the windbox being fed by a fan which may be controlled by, for instance, a variable speed motor or control damper. The windbox acts as a plenum to supply combustion air to a group of burner assemblies at the same time.

Conventional burner assemblies, such as that shown in U. S. Pat. No. 2,210,428 to Peabody, have been difficult to control. Such burner assemblies have registers which typically have had a shutter-like arrangement for controlling air flow, which shutter-like arrangement is located near the burner register discharge outlet immediately adjacent the throat of the furnace. These registers receive air from all sides and thus do not organize the air into a discrete stream in which total air flow may be measured. Moreover, the shutter-like air valves near the furnace throat, being subject to a very hostile environment involving high heat and combustion products, tend to become jammed and unusable. As such, they are typically left wide open by the furnace operator to avoid the problem of the shutter becoming stuck in an unduly restricted position. This, of course, has further reduced the opportunities for control of individual burner assemblies. Additionally, difficulties in measuring individual burner fuel flow increase the problems associated with control of the individual burner assemblies.

These problems with conventional burner assemblies have been resolved by the invention disclosed in U. S. Pat. No. 4,504,216 issued Mar. 12, 1985, to the present inventor, Donald K. Hagar, and to another co-inventor, Lyle D. Geiger, which patent is hereby incorporated herein by reference. In that patent, the burner assembly includes an air register surrounding the central fuel nozzle, which air register has an inwardly spiraling scroll passageway and a simple air control valve located upstream of the scroll passageway. With that invention, the combustion air is organized into a discrete flow path represented by the inwardly spiraling scroll passageway. This enables accurate measurement and control of the air flow. This control is enhanced by the simple upstream valve at the inlet to the scroll passageway, which valve is remote from the harsh environment at the outlet of the burner assembly. This simple valve is capable of controlling the entire air flow through any given burner assembly.

The present invention goes beyond the burner assembly itself, and provides an overall method and system in which the enhanced control capabilities offered by the burner assemblies of U.S. Pat. No. 4,504,216 become more fully realized through an overall method and arrangement which provides for optimum performance from a set of burner assemblies firing in unison.

SUMMARY OF THE INVENTION

It is an object of the present invention to provide a method of control and control system for a furnace to which fuel and combustion air are fed, which method and system achieve enhanced performance and efficiency and which accommodate varying conditions and circumstances.

It is also an object of the present invention to provide a method of control and control system for a furnace to which fuel and air are fed through a plurality of burner assemblies in which in the burner assemblies are individually controlled in response to conditions of the process and of the system so that each burner assembly is controlled so as to adapt to the particular circumstances under which that individual burner assembly is operating.

It is yet another object of the present invention to provide a method and system to achieve the optimum fuel/air mixture at each burner assembly in a system where fuel flow to each burner assembly cannot be precisely measured.

It is still another object of the present invention to provide a method and system for controlling the supply of fuel and combustion air to a furnace which takes advantage of the air measuring and flow control capabilities of a burner assembly of the kind which utilizes an inwardly spiraling scroll and an air control valve upstream of the scroll, as disclosed in U.S. Pat. No. 4,504,216.

These and other objects and advantages of the present invention will be apparent from the detailed description which follows and from the drawing.

DETAILED DESCRIPTION OF THE PREFERRED EMBODIMENT

Figure 1:
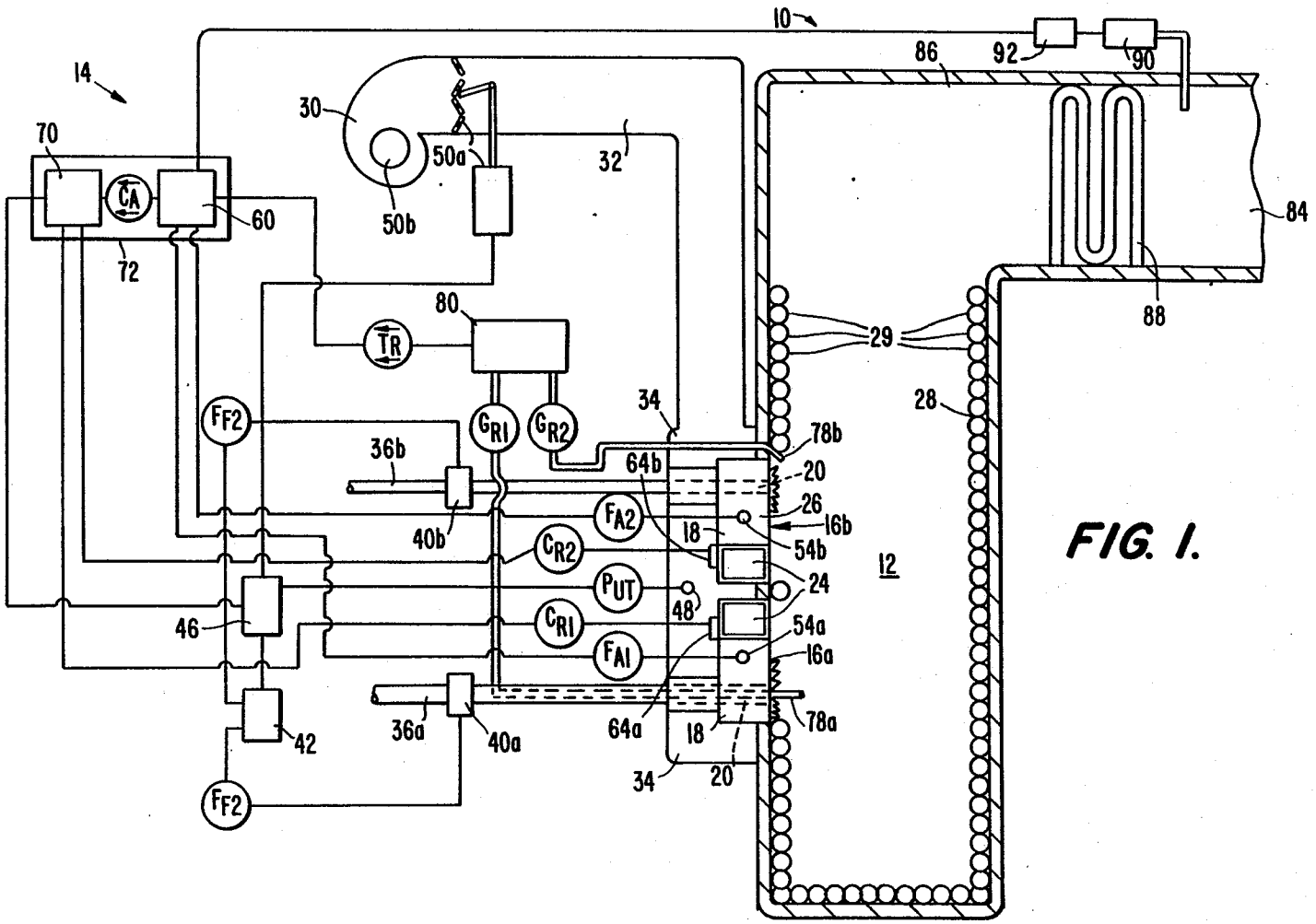
FIG. 1 shows a system, including a control system, for furnishing fuel and air to a furnace.
Figure 2:
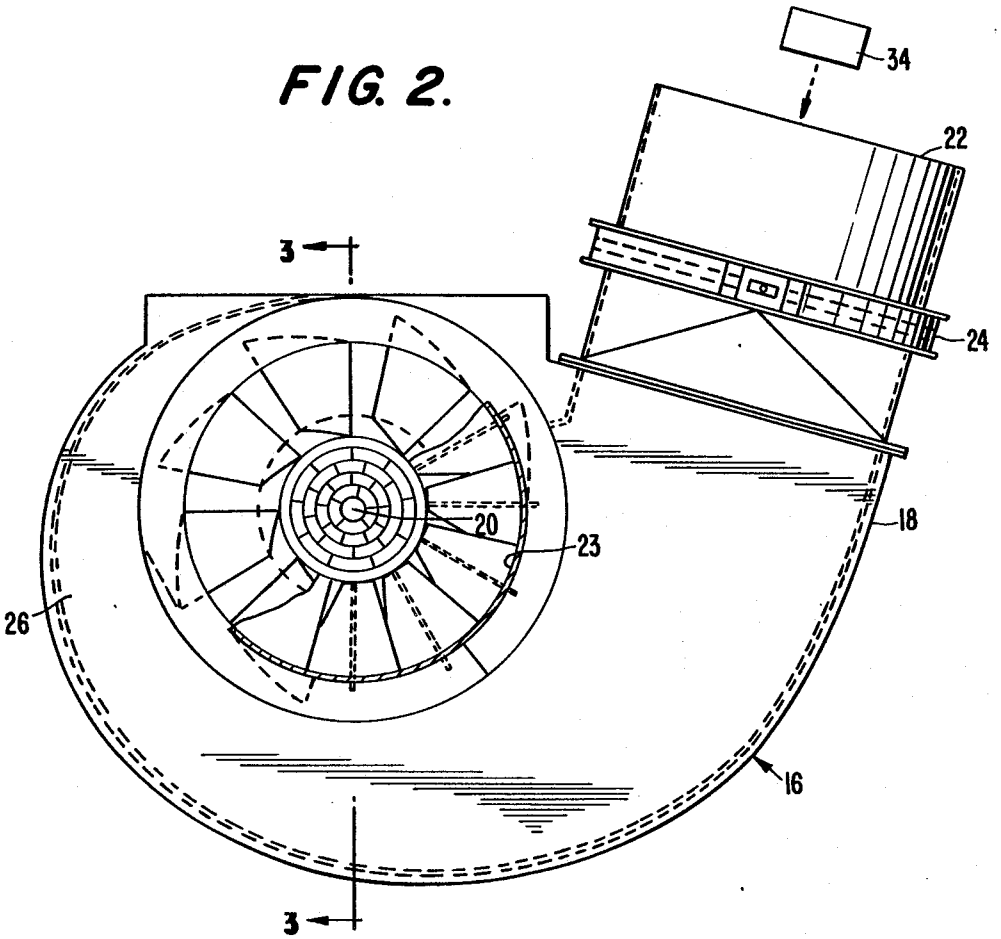
FIG. 2 is an elevational view of a burner assembly of the type used in the control system of FIG. 1.
Figure 3:
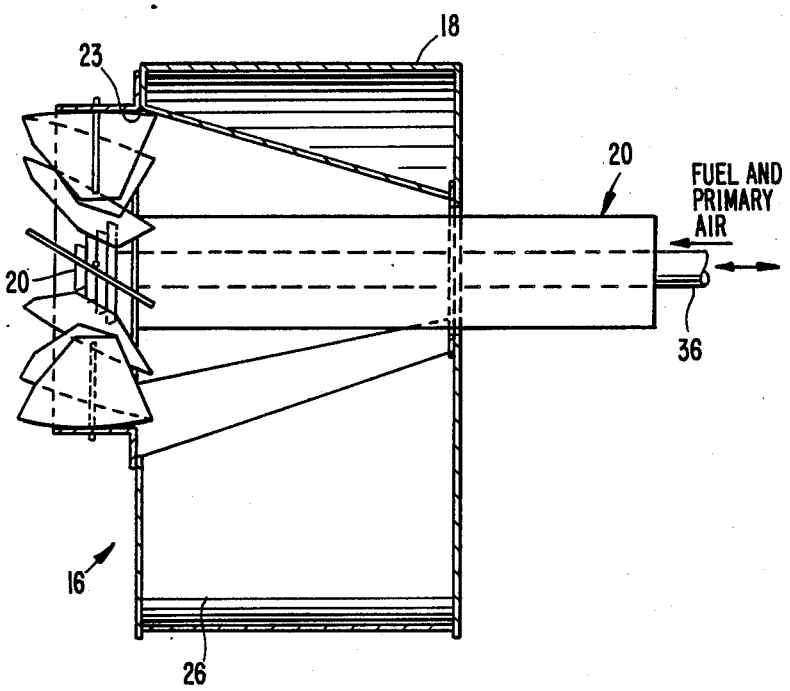
FIG. 3 is a sectional view taken on the line a—a of the burner assembly of FIG. 2.

Referring to FIG. 1, reference numeral 10 generally refers to an overall system for providing fuel and air to a furnace 12, while reference numeral 14 refers to the control system which establishes and maintains control over the supply of fuel and air to the furnace 12. The overall fuel and air system includes a plurality of burner assemblies 16*a*, 16*b*, each having an air register 18 for handling combustion air, which air register is concentrically disposed about a fuel nozzle 20 through which fuel is fed to the furnace. Each burner assembly includes a combustion air inlet 22, a combustion air outlet 23, and a simple air valve 24 disposed upstream of an inwardly spiraling scroll passageway 26 through which the combustion air flows before being discharged into furnace 12. The registers 18 are constructed in accordance with U.S. Pat. 4,504,216.

In a typical application, the fuel nozzle 20 feeds pulverized coal or another fuel, entrained in an air supply to the furnace, while the combustion air is introduced into the furnace 12 via the air register 18. In such an application, the air which entrains the fuel and which passes through the fuel nozzle 20 is referred to as "primary" air, whereas the combustion air which passes through the air register 18 is referred to as "secondary" air. In a typical application of this kind, the furnace 12 will actually be the furnace portion of a boiler 28 lined with boiler tubes 29. Typically too, the boiler will produce steam for generating electric power at a power plant.

Combustion air is fed to the register 18 via a forced draft fan 30 and an air conduit 32 extending between the fan 30 and a windbox 34. The windbox encloses each register 18 and serves as a plenum chamber to feed combustion air to each burner assembly **16*a* and 16*b*. Fuel is fed individually to the burner assemblies via fuel flow paths 36*a*, 36*b*. Fuel is then discharged from the fuel nozzles 20 and mixed with combustion air from air registers 18 of the burner assemblies at the opening to the furnace 12 to produce an individual flame for each burner assembly, which individual flame merges into an integrated fire in furnace 12**.

The control system 14 includes a plurality of fuel flow measuring instruments **40*b* a, 40*b* for measuring the fuel flow in one fuel flow path and for producing a set of signals $f_{f1}$ and $f_{f2}$ representative of fuel flows in the individual fuel flow paths 30*a*, 30*b*. Specifically, fuel flow meter 40*a* measures the fuel flow in flow path 36*a* to produce fuel flow signal $f_{f1}$. Fuel flow meter 40*b* measures the fuel flow in flow path 36*b* to produce a fuel flow signal $f_{f2}$. Fuel flow signals $f_{f1}$ and $f_{f2}$ are directed to a fuel flow signal comparator 42 connected with flow meters 40*a*, 40*b*. The fuel flow signal comparator 42 compares signals $f_{f1}$ and $f_{f2}$, and produces an output signal representative of the fuel flow in the fuel flow path 36*a* or 36*b*** having the greatest fuel flow.

The fuel flow signal comparator 42 is connected with a forced air pressure controller 46 which, in turn, is connected with a pressure sensor 48 for sensing the pressure in the windbox 34. Forced air pressure controller 46 is also coupled with a regulator for the air supply which may take the form of either a control damper **50*a* for fan 30 or a variable speed motor 50*b* for fan 30**.

The control system 14 senses the pressure, via sensor 48, of forced air being fed from the fan 30 through air conduit 32 into windbox 34. The control system regulates this supply of air to the registers of the burner assemblies in response to an output signal from the forced air pressure controller 46, which output signal is produced from the signal coming from the fuel flow signal comparator 42 and from the windbox pressure signal wf from the pressure sensor 48. With this arrangement, fuel flow in the path **36*a* or 36*b* having the greatest fuel flow determines the amount of combustion air available to all of the burner assemblies. In this way, an adequate supply of combustion air is assured for the burner requiring the greatest supply of combustion air. Of course, this burner is that to which leads the fuel flow path 40*a* or 40*b* having the greatest fuel flow. The pressure measured by sensor 48 is windbox pressure $p_w$, and the highest level of fuel flow establishes the correct value for $p_w$. Maximum fuel flow for any burner determines the windbox pressure required for the entire windbox, because sufficient air must be available for whatever burner assembly is firing at the maximum. Windbox pressure $p_w$, then, is established based on fuel flow reading and will be established by the highest fuel flow to the burner assemblies 16*a*, 16*b*. Thus, the combustion air pressure for each burner assembly 16*a*, 16*b* is, in essence, set by the fuel flow meters 40*a*, 40*b***.

A set of air flow measuring instruments **54*a*, 54*b*, one for each burner assembly, gauge the amount of combustion air flowing through each burner assembly. These air flow measuring instruments 54*a*, 54*b*, produce a set of air flow signals $f_{a1}$ and $f_{a2}$ representative of combustion air flow through the burner assemblies. Each air flow signal of the set is representative of the combustion air flow through one individual burner assembly. That is, signal $f_{a1}$ represents the combustion air flow through burner assembly 16*a* and air flow signal $f_{a2}$ represents the combustion air flow through burner assembly 16*b***.

An air signal processor 60 coupled with air flow measuring instruments **54*a*, 54*b* receives the air flow signals $f_{a1}$, $f_{a2}$ and tests and determines whether such air flow signals meet predetermined conditions. That is, the air signal processor 60 determines whether the air flow signals $f_{a1}$, $f_{a2}$ are within expected and acceptable ranges. If any of the air flow signals $f_{a1}$ or $f_{a2}$ are not within acceptable ranges, i.e., if they do not meet the predetermined conditions, air signal processor 60** produces a corrective signal $c_a$.

Air signal processor 60 is programmed to produce a corrective signal which will cause one of the burner assemblies to operate such that its air valve 24 is 100% open or nearly 100% open at virtually all times, which burner assembly, of course, will be the one receiving the maximum fuel. This assures maximum performance and efficiency by providing that, whichever burner assembly of the set of burner assemblies **16*a*, 16*b* is capable of operating at its maximum level, is indeed doing so. In addition, this arrangement provides a control loop since, if air flow signals $f_{a1}$, $f_{a2}$ are higher than expected, less wind box pressure $p_w$ is needed and the corrective signal $c_a$, which is fed back to forced air pressure controller 46, biases and trims the signal coming from forced air pressure controller 46** to reduce air flow and save energy.

The control system 14 also includes a set of register position determiners **64*a*, 64*b*, one for each burner assembly 16*a*, 16*b*. These register position determiners 64*a*, 64*b* individually position the air valve 24 of each burner assembly to achieve the required values of the air flow signals $f_{a1}$ and $f_{a2}$. A valve position control signal $c_{r1}$, representative of and determinative of the position of the air valve 24 of burner assembly 16*a*, and valve position control signal $c_{r2}$, representative of and determinative of the position of the air valve 24 of burner assembly 16*b*, are provided by position determiners 64*a*, 64*b***.

A register position comparator 70 is connected with air signal processor 60 to receive the corrective signal $c_a$ therefrom. Indeed, it is preferred that the air signal processor 60 and the register position comparator 70 make up a single processing unit 72.

Register position comparator 70 correlates and compares the relative positions of the air valves 24 in accordance with information received from the register position determiners **64*a*, 64*b*. These register position determiners are in communication with register position comparator 70 such that the information represented by their signals $c_{r1}$, $c_{r2}$ is available to register position comparator 70. The register position comparator, after correlating and comparing the valve position control signals $c_{r1}$ and $c_{r2}$, produces an output to adjust the relative-positions of the air valve 24 so that at least one burner assembly 16a or 16b** achieves a predetermined condition representing maximum performance.

For example, if the comparison of the signals $c_{r1}$ and $c_{r2}$ indicates that more than one burner assembly 16a, 16b has valves which are 100% open, then separate, individual control of the individual registers would be lost and one burner assembly would likely be operating with insufficient combustion air. To avoid that situation, processing unit 72, which is connected with forced air pressure controller 46, signals forced air pressure controller 46 to increase the overall air supply $p_w$ to ensure that at least one air valve 24 will close to regain control and ensure that the register of each burner assembly needing the most air has it.

Also, if the burner assembly 16a, 16b with the farthest open air valve 24 is less than 95% open, then the wind box pressure $p_w$ will be reduced to save energy in the operation of fan 30. Thus, the register position comparator 70, in conjunction with the air signal processor 60, ensures that the air valve 24 of each individual burner assembly 16 is not too far closed or too far open, and it does so by feeding back information to the forced air pressure controller 46. If the air valves 24 are too far closed, the register position comparator feeds information to the forced air pressure controller 46 to the effect that pressure is too high for the output conditions. Thus, the signal coming from the register position comparator 70 and fed to the forced air pressure controller 46 biases the signal coming from the forced air pressure controller 46 to trim the pressure $p_w$ down gradually. As the pressure $p_w$ is gradually trimmed down, the register position comparator will cause the air valves 24 of the burner assembly 16 to start opening by information derived from flow signals $f_{a1}$ and $f_{a2}$ and fed back to the register position comparator via air signal processor 60. When the air valves 16 continue opening to the point where one of them is at its maximal allowable opening, the trim signal being fed to the forced air pressure controller 46 is cut off by the register position comparator 70. The air valves will then stay in that position until conditions change again. In this way, maximum efficiency and performance are achieved, since one of the burner assemblies 16a, 16b will be operating at or near 100%, and no excess fan power is used.

The control method and system as described above will provide for adequate control if the fuel flow measurements from flow meters 40a, 40b are accurate and produce fuel flow signals $f_{f1}$ and $f_{f2}$ truly representative of the amount of energy, in the form of fuel, being delivered to the fuel burners or nozzles 20 of the burner assemblies 16a, 16b. Since fuels vary, however, the fuel flow signals $f_{f1}$ and $f_{f2}$ are not reliable. The additional control to be described now accommodates for this.

Control system 14 includes a set of flame reading instruments 78a, 78b, one for each burner assembly, Thus, flame reading instrument 78a is for burner assembly 16a, and flame reading instrument 78b is for burner assembly 16b. The flame reading instruments 78a, 78b each read a characteristic of the flame produced in the furnace 12 by the associated burner assembly 16a, 16b. In other words, each flame reading instrument 78a, 78b provides a separate reading for the individual flame of each individual burner assembly 16a, 16b. These individual flame or gas readings $g_{r1}$ and $g_{r2}$ are fed to a flame reading processor 80 which is in communication with the flame reading instruments 78a, 78b and with the air signal processor 60. The flame reading processor 80, upon receiving the readings from the flame reading instruments 78a, 78b, processes the readings and relates and compares the readings to predetermined values. If the readings do not conform to predetermined values, the flame reading processor 80 sends trim signals $tr_1$ and $tr_2$ to the air signal processor 60 which, in turn, will modify its corrective signal $ca_1$ or $ca_2$ to produce corrective action so that the predetermined values for flame readings are met.

The flame reading instruments preferably use a hollow center of each fuel nozzle 20 as a sampling port. (See instrument 78a.) Alternatively, a water-cooled probe, disposed adjacent to the burner, may penetrate the furnace wall to read each individual flame of each burner assembly 16. See instrument 78b.) In any case, the gas sample is taken in the vicinity of the individual flame of the individual burner assemblies.

The flame reading processor may include a multi-port gas sampler. In other words, there must be provision for sampling the gas of each burner, even if the processor 80 which does so is a single unit. Preferably, the flame reading processor 80 with its gas sampler determines the carbon monoxide level in the gas produced by the flame of each individual burner assembly. Alternatively, the oxygen level of such gas may be determined.

As an example of the action of the flame reading processor 80, let it be assumed that the fuel density in fuel flow path 36a is higher than in fuel flow path 36b, but the flow meters 40a, 40b show identical fuel flows. The amount of energy being delivered in the form of fuel in path 36a is higher than in path 36b. The portion of control system 14 which does not include flame reading processor 80 would assume identical energy in the form of fuel being delivered to the fuel nozzles 20 and control the system accordingly. However, the readings produced by the flame reading instruments 78a, 78b in the form of extractive samplers would show an unexpected variation in the gas sample, for instance, an elevated reading for carbon monoxide at the burner getting the excess fuel. The resulting trim signal $c_r$ from flame reading processor 80 is fed back to the air signal processor 60 which, in turn, feeds the signal to the register position comparator 70 to produce a signal to open up the valves 24 of the burner assembly 16a, 16b receiving the excess fuel. The readjustment of that register assembly may, in turn, result in the register position comparator 70 feeding a signal to the forced air pressure controller 46 to balance the relative valve positions of the registers of the burner assemblies and the pressure of forced air $p_w$ in the manner previously described.

The flame reading processor 80 which takes the extracted samples and reads them with its gas sampler to produce trim signal $t_r$, does so in a very slow reacting fashion. That is, flame reading processor 80 delays the sending of trim signal $t_r$ to air signal processor 60 to avoid an unstable condition and to avoid "hunting" in the overall control system 14. Thus, if the gas sampler of the flame reading processor 80 indicated low oxygen or high carbon monoxide in a particular burner assembly 16a, 16b, it would, via the air signal processor 60, slowly bias the signal $C_A$ coming from the air signal processor to reflect the fact that the signals which it is receiving are based on fuel flows of which one such flow is really higher than the actual fuel flow. The corrective signal $C_A$ coming from air signal processor 60 will be biased accordingly, which signal is fed back via register position comparator 70 to forced air pressure controller 46 and to the register position determiners via register position comparator 70 to adjust the overall system to accommodate for the error in the fuel flow reading.

The flame reading instruments 78*a*, 78*b* which preferably take the form of gas samplers, will also preferably be capable of operating with a puff cycle. The system will alternately puff compressed air through the sampler pipe to make sure that the sampling pipe is not plugging up. The system will then switch a set of three valves to suck gas through the sampler to perform the flame reading function. Thus, the sampling takes place intermittently.

The particular processors used in connection with the control system 14 are commercially available processors which are programmed and connected to operating in accordance with the method and system of the present invention as described above. For instance, the processing unit 72 may be a Network 90 boiler computer available from the Bailey Controls Division of Babcock & Wilcox, or it may be a controller from Foxboro/Jordan of Milwaukee, Wis.

The control system 14 of the present invention preferably includes a failsafe subsystem to accommodate for sensor failure. Near the outlet 84 of boiler 28, well downstream of the flames of the individual burner assemblies 16*a*, 16*b*, and past the convective sections 86 and superheater 88, is another gas monitor 90 for carbon monoxide or oxygen, or both. Gas monitor 90 determines whether the gas leaving the furnace has approximately the right amount of excess air based on expectations. That is, gas monitor 90 checks a selected characteristic, such as oxygen or carbon monoxide, of the integrated fire which is downstream of the individual flames of the burner assemblies and determines whether the selected characteristic of the integrated fire falls within a range of acceptable values for that characteristic. If the characteristic has a value outside the acceptable range, the gas monitor 90 triggers an alarm 92 which is in communication with gas monitor 90 to produce a alarm signal to alert the operator that there is a malfunction in the control system.

While the present invention has been described in connection with a certain preferred embodiment, it will be understood that many additional embodiments, variations and modifications may be made to the preferred embodiment without departing from the spirit and scope of the appended claims.

What is claimed is:

1. A method for providing fuel and air to a furnace through a plurality of burner assemblies, each burner assembly including a combustion air register, each combustion air register including a combustion air passageway that produces a discrete air flow path of combustion air, an air valve for controlling the flow of combustion air through the burner assembly, and an air flow meter located exclusively in that combustion air register for measuring the air flow through the discrete air flow path downstream of the air valve, the method comprising the steps of:

(a) sensing a combustion characteristic produced by each separate burner assembly;

(b) sensing the air flow through each separate burner assembly by taking a separate measurement exclusively of the air flow through the discrete air flow path of each combustion air register downstream of the air valve, each such separate measurement being taken with the air flow meter for the combustion air register in which the measurement is being taken; and (c) separately controlling each individual air valve in response to the combustion characteristic sensed in step (a) and the air flows sensed in step (b) to thereby individually control the performance of each burner assembly.

2. A method for providing fuel and air to a furnace through a plurality of burner assemblies contained in a windbox, each burner assembly including a combustion air register having a combustion air passageway that produces a discrete air flow path, an air valve for controlling the flow of combustion air through the burner assembly, and an air flow meter located exclusively in that combustion air register for measuring the air flow through the discrete air flow path downstream of the air valve, the method comprising the steps of:

(a) sensing a combustion characteristic produced by each separate burner assembly;

(b) sensing the air flow through each separate burner assembly by taking a separate measurement exclusively of the air flow through the discrete air flow path of each combustion air register downstream of the air valve, each such separate measurement being taken with the air flow meter for the combustion air register in which the measurement is being taken; and (c) separately controlling each individual air valve in response to at least one of the combustion characteristic sensed in step (a) and the air flow measured in step (b) to thereby individually control the performance of each burner assembly;

wherein each burner assembly produces a flame and said step of sensing a combustion characteristic produced by each separate burner assembly includes taking gas composition samples in the vicinities of the flames of the individual burner assemblies.

3. A method as defined in claim 2, wherein the combustion characteristic is the relative amount of carbon monoxide in the gas sample taken.

4. A method as defined in claim 2, wherein the combustion characteristic is the relative amount of oxygen in the gas sample taken.

* * * * *